US011308875B2

(12) United States Patent
Song

(10) Patent No.: US 11,308,875 B2
(45) Date of Patent: Apr. 19, 2022

(54) DETECTION METHOD OF PIXEL CIRCUIT, DRIVING METHOD OF DISPLAY PANEL AND DISPLAY PANEL

(71) Applicant: BOE TECHNOLOGY GROUP CO., LTD., Beijing (CN)

(72) Inventor: Danna Song, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 441 days.

(21) Appl. No.: 16/469,375

(22) PCT Filed: Jan. 15, 2019

(86) PCT No.: PCT/CN2019/071804
§ 371 (c)(1),
(2) Date: Jun. 13, 2019

(87) PCT Pub. No.: WO2019/205750
PCT Pub. Date: Oct. 31, 2019

(65) Prior Publication Data

US 2021/0366388 A1 Nov. 25, 2021

(30) Foreign Application Priority Data

Apr. 26, 2018 (CN) ..... 201810386462.X

(51) Int. Cl.
*G09G 3/3233* (2016.01)
*G09G 3/3258* (2016.01)
*G09G 3/3291* (2016.01)

(52) U.S. Cl.
CPC ..... *G09G 3/3233* (2013.01); *G09G 3/3258* (2013.01); *G09G 3/3291* (2013.01);
(Continued)

(58) Field of Classification Search
CPC .. G09G 3/3233; G09G 3/3291; G09G 3/3258; G09G 2310/0278; G09G 2320/045; G09G 3/325; G09G 2320/04–048
See application file for complete search history.

(56) References Cited

U.S. PATENT DOCUMENTS 9,424,770 B2 8/2016 Kim et al.
9,779,666 B2 10/2017 Kwon et al.
(Continued)

FOREIGN PATENT DOCUMENTS

CN 103854602 A 6/2014
CN 104637441 A 5/2015
(Continued)

OTHER PUBLICATIONS

International Search Report of PCT/CN2019/071804 in Chinese, dated Apr. 9, 2019, with English translation.
(Continued)

*Primary Examiner* — Roberto W Flores
(74) *Attorney, Agent, or Firm* — Collard & Roe, P.C.

(57) ABSTRACT

A detection method of a pixel circuit, a display panel and a driving method thereof are provided. The detection method includes: during a reference charging period, applying a reference data voltage to a gate electrode of a driving transistor, and at a first time duration after applying the reference data voltage, obtaining a benchmark voltage from a sensing line; and during a data charging period, applying a detection data voltage different from the reference data voltage to the gate electrode of the driving transistor, and at the first time duration after applying the detection data voltage, obtaining an initial sensing voltage from the sensing line. A sensing voltage of the pixel circuit is obtained based on at least the benchmark voltage and the initial sensing
(Continued)

voltage, and a threshold voltage of the driving transistor is obtained based on the sensing voltage.

17 Claims, 8 Drawing Sheets

(52) U.S. Cl.
CPC ..... *G09G 2310/0278* (2013.01); *G09G 2320/045* (2013.01)

(56) References Cited

U.S. PATENT DOCUMENTS

| | | | | |
|---|---|---|---|---|
| 9,905,160 | B2 | 2/2018 | Woo et al. | |
| 10,002,569 | B2 | 6/2018 | Park et al. | |
| 10,089,928 | B2 | 10/2018 | Yoo et al. | |
| 10,446,621 | B2 | 10/2019 | Kim et al. | |
| 2010/0302202 | A1 | 12/2010 | Takeuchi et al. | |
| 2015/0130780 | A1* | 5/2015 | Kwon | G09G 3/3233 345/212 |
| 2015/0187267 | A1 | 7/2015 | Park et al. | |
| 2016/0086544 | A1 | 3/2016 | Park et al. | |
| 2017/0004764 | A1 | 1/2017 | Kim et al. | |
| 2017/0053590 | A1 | 2/2017 | Song et al. | |
| 2018/0033366 | A1* | 2/2018 | Yoo | G09G 3/3233 |
| 2018/0240403 | A1 | 8/2018 | Wang et al. | |
| 2019/0147797 | A1 | 5/2019 | Yuan et al. | |
| 2019/0172394 | A1 | 6/2019 | Wang et al. | |

FOREIGN PATENT DOCUMENTS

| | | | |
|---|---|---|---|
| CN | 104700761 | A | 6/2015 |
| CN | 105427796 | A | 3/2016 |
| CN | 105448238 | A | 3/2016 |
| CN | 106328062 | A | 1/2017 |
| CN | 106782320 | A | 5/2017 |
| CN | 107657923 | A | 2/2018 |
| CN | 107665671 | A | 2/2018 |
| CN | 107749280 | A | 3/2018 |
| CN | 107799060 | A | 3/2018 |
| CN | 108597449 | A | 9/2018 |
| KR | 10-2015-0071546 | A | 6/2015 |
| KR | 10-2015-0076033 | A | 7/2015 |
| KR | 10-2017-0081049 | A | 7/2017 |

OTHER PUBLICATIONS

Notice of Transmittal of the International Search Report of PCT/CN2019/071804 in Chinese, dated Apr. 9, 2019.

Written Opinion of the International Searching Authority of PCT/CN2019/071804 in Chinese, dated Apr. 9, 2019 with English translation.

Chinese Office Action in Chinese Application No. 201810386462.X, dated Jul. 29, 2019 with English translation.

* cited by examiner

DETECTION METHOD OF PIXEL CIRCUIT, DRIVING METHOD OF DISPLAY PANEL AND DISPLAY PANEL

CROSS REFERENCE TO RELATED APPLICATIONS

This application is the National Stage of PCT/CN2019/071804 filed on Jan. 15, 2019, which claims priority under 35 U.S.C. § 119 of Chinese Application No. 201810386462.X filed on Apr. 26, 2018, the disclosure of which is incorporated by reference.

TECHNICAL FIELD

Embodiments of the present disclosure relate to a detection method of a pixel circuit, a driving method of a display panel and a display panel.

BACKGROUND

Organic light emitting diode (OLED) display devices have characteristics such as wide viewing angle, high contrast ratio, fast response speed, etc. Moreover, organic light emitting diode display devices have advantages of higher brightness, lower driving voltage and the like, compared with inorganic light emitting display devices. Due to the above characteristics and advantages, organic light emitting diode (OLED) display devices have gradually attracted more and more attention, and can be applied to apparatuses having a display function, such as mobile phones, displays, notebook computers, digital cameras, instruments, meters and the like.

SUMMARY

At least one embodiment of the present disclosure provides a detection method of a pixel circuit, the pixel circuit including a driving transistor, the driving transistor including a gate electrode and a first electrode, the first electrode of the driving transistor being coupled to a sensing line, the detection method including: during a reference charging period, applying a reference data voltage to the gate electrode of the driving transistor to charge the sensing line through the first electrode of the driving transistor, and at a first time duration after applying the reference data voltage, obtaining a benchmark voltage from the sensing line; and during a data charging period, applying a detection data voltage different from the reference data voltage to the gate electrode of the driving transistor to charge the sensing line through the first electrode of the driving transistor, and at the first time duration after applying the detection data voltage, obtaining an initial sensing voltage from the sensing line. A sensing voltage of the pixel circuit is obtained based on at least the benchmark voltage and the initial sensing voltage, and a threshold voltage of the driving transistor is obtained based on the sensing voltage.

For example, in the detection method provided by an embodiment of the present disclosure, the reference data voltage is zero.

For example, in the detection method provided by an embodiment of the present disclosure, the sensing voltage of the pixel circuit is equal to a difference between the initial sensing voltage and the benchmark voltage.

For example, in the detection method provided by an embodiment of the present disclosure, a predetermined interval is set between adjacent display frames; and the reference charging period and the data charging period are both in a same predetermined interval.

For example, in the detection method provided by an embodiment of the present disclosure, the reference charging period is before the data charging period.

For example, the detection method provided by an embodiment of the present disclosure further includes: during a supplementary reference charging period, applying the reference data voltage to the gate electrode of the driving transistor to charge the sensing line through the first electrode of the driving transistor, and at the first time duration after applying the reference data voltage, obtaining a supplementary benchmark voltage from the sensing line; the reference charging period, the supplementary reference charging period and the data charging period are all in a same predetermined interval, and the supplementary reference charging period is after the data charging period; and the sensing voltage of the pixel circuit is obtained based on the benchmark voltage, the supplementary benchmark voltage and the initial sensing voltage.

For example, in the detection method provided by an embodiment of the present disclosure, the sensing voltage of the pixel circuit is equal to a difference between the initial sensing voltage and an average of the benchmark voltage and the supplementary benchmark voltage.

For example, in the detection method provided by an embodiment of the present disclosure, the pixel circuit further includes a first transistor and a storage capacitor, a first electrode of the first transistor and a second electrode of the first transistor are respectively connected to a signal line and the gate electrode of the driving transistor, a first terminal of the storage capacitor and a second terminal of the storage capacitor are respectively connected to the gate electrode of the driving transistor and the first electrode of the driving transistor; the detection method further includes: during the reference charging period, turning on the first transistor to continuously apply the reference data voltage to the gate electrode of the driving transistor in a time period before obtaining the benchmark voltage; and during the data charging period, turning on the first transistor to continuously apply the detection data voltage to the gate electrode of the driving transistor in a time period before obtaining the initial sensing voltage.

For example, in the detection method provided by an embodiment of the present disclosure, the pixel circuit further includes a second transistor, a first electrode of the second transistor is connected to the first electrode of the driving transistor, and a second electrode of the second transistor is connected to the sensing line; the detection method further includes: turning off the first transistor and the second transistor before obtaining the initial sensing voltage.

For example, in the detection method provided by an embodiment of the present disclosure, the pixel circuit further includes a first transistor and a storage capacitor, a first electrode of the first transistor and a second electrode of the first transistor are respectively connected to a signal line and the gate electrode of the driving transistor, a first terminal of the storage capacitor and a second terminal of the storage capacitor are respectively connected to the gate electrode of the driving transistor and the first electrode of the driving transistor; the detection method further includes: during the data charging period, turning off the first transistor after applying the detection data voltage to the gate electrode of the driving transistor, and-turning on the first transistor again before obtaining the initial sensing voltage; and during the turning off of the first transistor, a voltage supplied from the signal line to the gate electrode of the driving transistor is converted from the detection data voltage to a second detection data voltage having a voltage value less than the detection data voltage.

For example, in the detection method provided by an embodiment of the present disclosure, the second detection data voltage is zero.

For example, in the detection method provided by an embodiment of the present disclosure, a second electrode of the driving transistor is coupled to a first power voltage terminal to receive a first power voltage.

At least one embodiment of the present disclosure further provides a driving method of a display panel, the display panel including a pixel circuit and a sensing line, the pixel circuit including a driving transistor, the driving transistor including a gate electrode and a first electrode, the sensing line being coupled to the first electrode of the driving transistor, the driving method including: during a reference charging period, applying a reference data voltage to the gate electrode of the driving transistor to charge the sensing line through the first electrode of the driving transistor, and at a first time duration after applying the reference data voltage, obtaining a benchmark voltage from the sensing line; and during a data charging period, applying a detection data voltage different from the reference data voltage to the gate electrode of the driving transistor to charge the sensing line through the first electrode of the driving transistor, and at the first time duration after applying the detection data voltage, obtaining an initial sensing voltage from the sensing line; a sensing voltage of the pixel circuit is obtained based on at least the benchmark voltage and the initial sensing voltage, and a threshold voltage of the driving transistor is obtained based on the sensing voltage.

For example, the driving method provided by an embodiment of the present disclosure further includes: establishing a compensation amount of a sub-pixel unit including the pixel circuit according to the threshold voltage being obtained.

For example, the driving method provided by an embodiment of the present disclosure further includes: during a display operation period of the display panel, compensating the sub-pixel unit with the compensation amount.

At least one embodiment of the present disclosure further provides a display panel, including a pixel circuit, a sensing line and a control circuit, the pixel circuit including a driving transistor, the driving transistor including a gate electrode and a first electrode, the sensing line being coupled to the first electrode of the driving transistor; the control circuit is configured to perform a detection method for the pixel circuit or a driving method for the display panel as follows: during a reference charging period, applying a reference data voltage to the gate electrode of the driving transistor to charge the sensing line through the first electrode of the driving transistor, and at a first time duration after applying the reference data voltage, obtaining a benchmark voltage from the sensing line; and during a data charging period, applying a detection data voltage different from the reference data voltage to the gate electrode of the driving transistor to charge the sensing line through the first electrode of the driving transistor, and at the first time duration after applying the detection data voltage, obtaining an initial sensing voltage from the sensing line; a sensing voltage of the pixel circuit is obtained based on at least the benchmark voltage and the initial sensing voltage, and a threshold voltage of the driving transistor is obtained based on the sensing voltage.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

FIG. 1E is a driving timing schematic diagram for detecting a threshold voltage of a driving transistor during power-on;

DETAILED DESCRIPTION

Figure 1A:
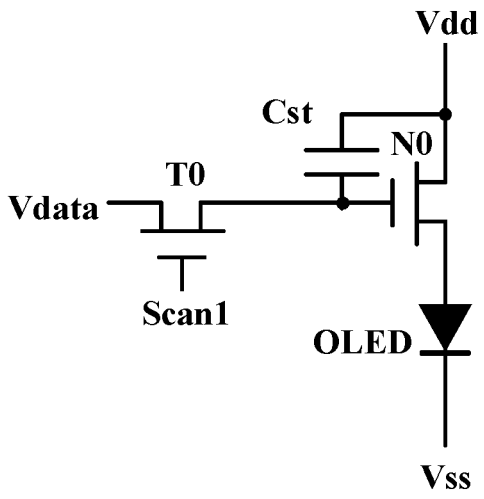
FIG. 1A is a schematic diagram of a pixel circuit.

Hereinafter, the technical solutions of the embodiments of the present disclosure will be described in a clearly and fully understandable way in connection with the accompanying drawings. With reference to the non-limiting exemplary embodiments shown in the accompanying drawings and detailed in the following description, the exemplary embodiments of the present disclosure and various features and advantageous details thereof will be fully illustrated. It should be noted that, the features shown in the figures are not necessarily drawn to scale. The present disclosure omits descriptions of known materials, components and process techniques so as not to obscure the exemplary embodiments of the present disclosure. The examples given are intended only to facilitate understanding of the implementations of the embodiments of the present disclosure and to further enable those skilled in the art to implement the exemplary embodiments. Therefore, these examples should not be construed as limitation of the scope of the embodiments of the present disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Furthermore, in the embodiments of the present disclosure, the same or similar reference numerals indicate the same or similar components.

Sub-pixel units in an organic light emitting diode (OLED) display panel are generally drove in a matrix driving manner. According to whether or not a switching element is introduced in each sub-pixel unit, the OLED display panel is divided into an active matrix (AM) driving type and a passive matrix (PM) driving type. An AMOLED (i.e., active matrix driving type of OLED) display panel integrates a set of thin film transistors and storage capacitors in a pixel circuit of each sub-pixel unit. By driving and controlling the thin film transistors and the storage capacitors, it can be realized to control currents flowing through the OLED, so that the OLED can emit light as needed.

Figure 1B:
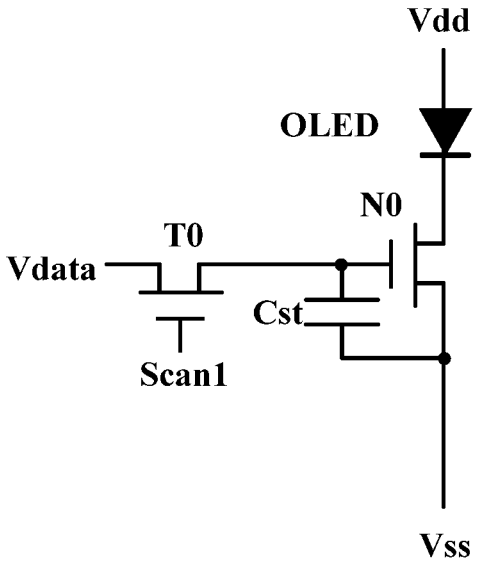
FIG. 1B is a schematic diagram of another pixel circuit.

A basic pixel circuit used by the sub-pixel unit in the AMOLED display panel is usually a 2T1C pixel circuit, which uses two thin film transistors (TFTs) and one storage capacitor Cst to realize the basic function of driving OLED to emit light. FIG. 1A and FIG. 1B are schematic diagrams showing two kind of 2T1C pixel circuits, respectively.

As shown in FIG. 1A, a kind of 2T1C pixel circuit includes a switching transistor T0, a driving transistor N0, and a storage capacitor Cst. For example, a gate electrode of the switching transistor T0 is connected to a scan line to receive a scan signal Scant, for example, a source electrode of the switching transistor T0 is connected to a signal line to receive a data signal Vdata, and a drain electrode of the switching transistor T0 is connected to a gate electrode of the driving transistor N0; a source electrode of the driving transistor N0 is connected to a first voltage terminal to receive a first voltage Vdd (high voltage), and a drain electrode of the driving transistor N0 is connected to an anode of an OLED; a terminal of the storage capacitor Cst is connected to the drain electrode of the switching transistor T0 and the gate electrode of the driving transistor N0, and another terminal of the storage capacitor Cst is connected to the source electrode of the driving transistor N0 and the first voltage terminal; and a cathode of the OLED is connected to a second voltage terminal to receive a second voltage Vss (low voltage, such as a grounded voltage). The 2T1C pixel circuit uses the two TFTs and the storage capacitor Cst to control a brightness and darkness (grayscale) of the pixel. When the scan signal Scan1 is applied through the scan line to turn on the switching transistor T0, the data signal Vdata written by a data driving circuit through the signal line charges the storage capacitor Cst via the switching transistor T0, therefore the data signal Vdata is stored in the storage capacitor Cst, and the data signal Vdata stored in the storage capacitor Cs controls a turn-on degree of the driving transistor N0, so that a value of the current flowing through the driving transistor is controlled to drive the OLED to emit light, and the value of the current determines a grayscale of a illumination of the pixel. In the 2T1C pixel circuit as shown in FIG. 1A, the switching transistor T0 is an N-type transistor and the driving transistor N0 is a P-type transistor.

As shown in FIG. 1B, another kind of 2T1C pixel circuit also includes a switching transistor T0, a driving transistor N0 and a storage capacitor Cs, but the connection mode thereof is slightly changed, and the driving transistor N0 is an N-type transistor. Differences of the pixel circuit as shown in FIG. 1B compared with the pixel circuit as shown in FIG. 1A includes that: the anode of the OLED is connected to the first voltage terminal to receive the first voltage Vdd (high voltage), the cathode of the OLED is connected to a drain electrode of the driving transistor N0, and a source electrode of the driving transistor N0 is connected to the second voltage terminal to receive the second voltage Vss (low voltage, for example, a grounded voltage). A terminal of the storage capacitor Cs is connected to a drain electrode of the switching transistor T0 and a gate electrode of the driving transistor N0, and another terminal of the storage capacitor Cst is connected to the source electrode of the driving transistor N0 and the second voltage terminal. An operation mode of the 2T1C pixel circuit is basically identical to an operation mode of the pixel circuit as shown in FIG. 1A, and details are not described here again.

In addition, for the pixel circuit as shown in FIG. 1A and the pixel circuit as shown in FIG. 1B, the switching transistor T0 is not limited to the N-type transistor, and may be a P-type transistor as needed, thereby an polarity of the scan signal Scan1 that controls the switching transistor T0 to be turned on or turned off may be changed accordingly.

The OLED display panel includes a plurality of sub-pixel units arranged in an array, each of the sub-pixel units can include, for example, the above-described pixel circuit. In the OLED display panel, threshold voltages of driving transistors in pixel circuits of respective sub-pixel units may be different due to the fabrication process, and a threshold voltage of a driving transistor may be drifted due to, for example, the influence of temperature variation. Therefore, the difference in threshold voltages of respective driving transistors may cause display failure (for example, display unevenness), so it is necessary to compensate the threshold voltage of the driving transistor.

Figure 1C:
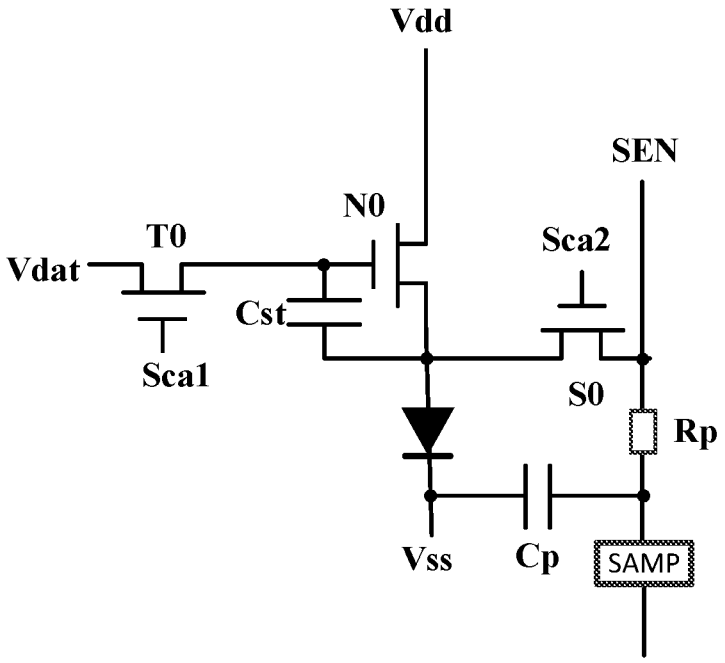
FIG. 1C is a schematic diagram of further another pixel circuit.

For example, FIG. 1C shows a pixel circuit design (i.e., a 3T1C circuit) that can detect a threshold voltage of a driving transistor in the pixel circuit, and the driving transistor N0 is an N-type transistor. For example, as shown in FIG. 1C, in order to implement a compensation function, a sensing transistor S0, a sensing line SEN, a detection circuit SAMP, an analog-to-digital converter ADC (not shown) and the like, are introduced on the basis of the 2T1C circuit. For example, a first terminal of the sensing transistor S0 cab be connected to a source electrode of the driving transistor N0 (an example of a first electrode being sensed), and a second terminal of the sensing transistor S0 is connected to the detection circuit SAMP through the sensing line, and a control terminal of the sensing transistor S0 can receive a scan signal Sca2. For example, there exists a parasitic capacitance Cp and a parasitic resistance Rp on the sensing line SEN.

For example, after the driving transistor N0 is turned on, that is, after a data signal (e.g., a data voltage) Vdata is applied to a gate electrode of the driving transistor N0 via the switching transistor T0, the driving transistor N0 is turned on under the control of the data signal Vdata, therefore, the sensing line SEN can be charged via the source electrode of the driving transistor N0 and the sensing transistor S0 so that a potential of the source electrode of the driving transistor N0 is changed. In a case where a voltage Vs of the source electrode of the driving transistor N0 is equal to a difference between a voltage Vg of the gate electrode of the driving transistor N0 and a threshold voltage Vth of the driving transistor (i.e., $Vg-Vs-Vth=Vgs-Vth=0$), the driving transistor N0 can be turned off, and the charging process is completed. At this time, the voltage Vs can be obtained through the sensing line SEN, and the threshold voltage Vth can be obtained based on the voltage Vs and the data voltage Vdata.

The inventors have noted that a reference threshold voltage Vth' and/or a parameter K of the driving transistor of the pixel circuit can be obtained during power-off, and the obtained reference threshold voltage Vth' and/or the parameter K can be used for detection (e.g., a real-time detection) of the threshold voltage Vth of the driving transistor during a power-on display phase. The following is an exemplary illustration of using the reference threshold voltage Vth' of the driving transistor of the pixel circuit obtained in a power-off display phase and detecting the threshold voltage Vth of the driving transistor in the power-on display phase, with reference to FIG. 1C—FIG. 1F.

Figure 1D:
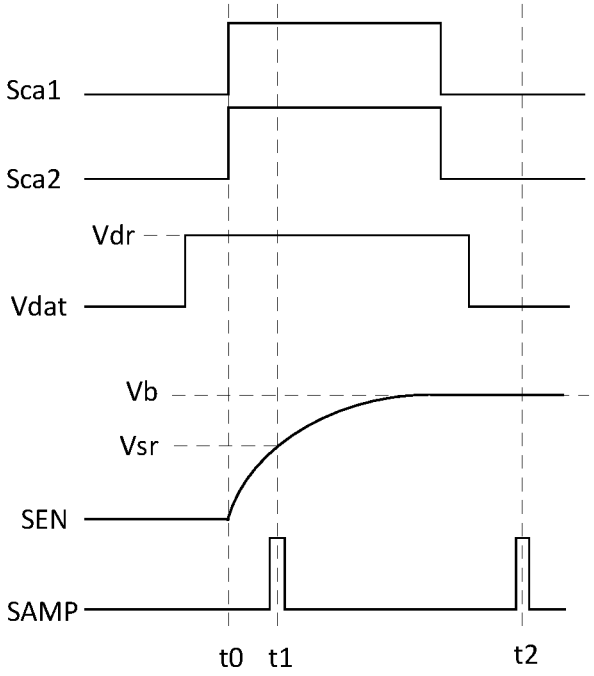
FIG. 1D is a driving timing schematic diagram for obtaining a reference sensing voltage and a turn-off sensing voltage during power-off.

For example, as shown in FIG. 1D, a voltage Vdr can be applied to the gate electrode of the driving transistor during power-off, and a reference sensing voltage Vsr and a turn-off sensing voltage Vb can be obtained at a first electrode of the driving transistor respectively before the driving transistor is turned off (for example, at time t1) and after the driving transistor is turned off (for example, at time t2), therefore the reference threshold voltage Vth' of the pixel circuit, that is, Vth'=Vdr-Vb, can be obtained. Thereafter, the reference threshold voltage Vth', the voltage Vdr, and the reference sensing voltage Vsr can be stored, for example, in a memory of the OLED, and be used to detect the threshold voltage Vth of the driving transistor in the power-on display phase.

For example, the method of detecting a reference sensing voltage, a turn-off sensing voltage and a reference threshold voltage of a driving transistor of a single pixel circuit during power-off is described above. Hereinafter, a method of detecting reference sensing voltages of driving transistors of a plurality of pixel circuits (e.g., four rows of sub-pixel units of a display panel) during power-off is described in detail with reference to FIG. 1F.

Figure 1E:
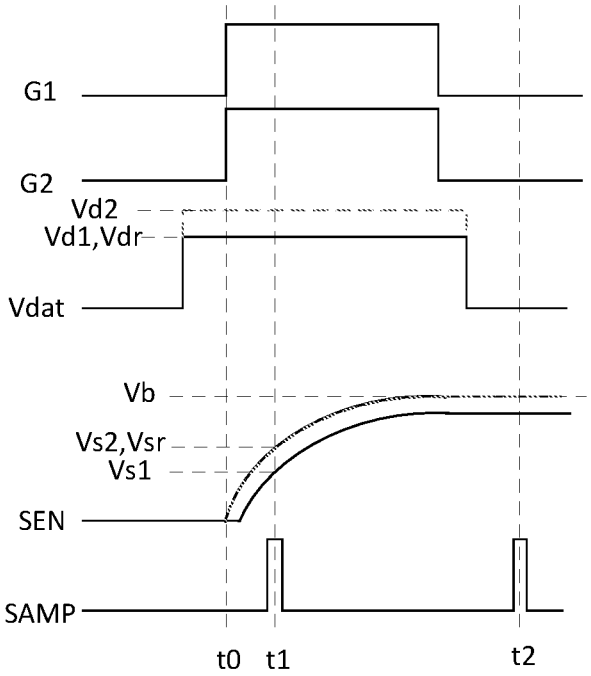
Figure 1F:
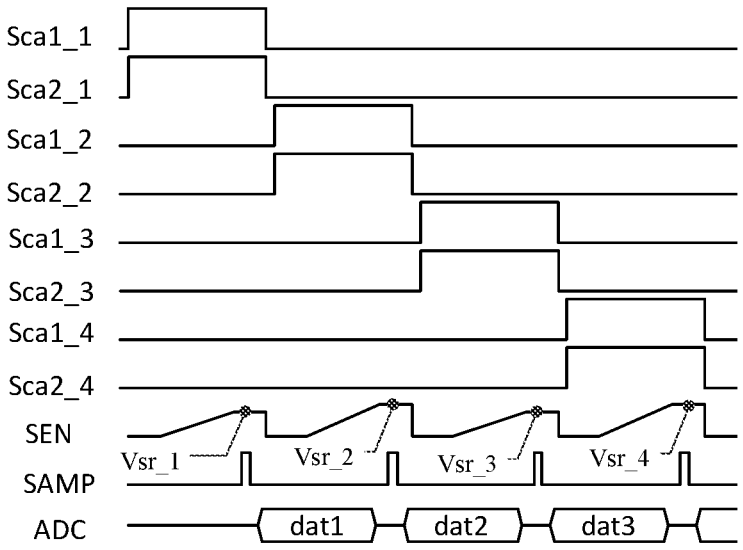
FIG. 1F is a driving timing schematic diagram for obtaining reference sensing voltages of driving transistors of a plurality of pixel circuits.

For example, as shown in FIG. 1F, firstly, a scan signal Sca1_1 and a scan signal Sca2_1 can be applied to control terminals of switching transistors and control terminals of sensing transistors located in a first row, respectively, and reference sensing voltages Vsr_1 of driving transistors located in the first row are obtained in a predetermined time duration after applying the scan signal Sca1_1 and the scan signal Sca2_1; then, a scan signal Sca1_2 and a scan signal Sca2_2 can be applied to control terminals of the switching transistors and control terminals of the sensing transistors located in a second row, respectively, and reference sensing voltages Vsr_2 of driving transistors located in the second row are obtained in a predetermined time duration after applying the scan signal Sca1_2 and the scan signal Sca2_2; next, a scan signal Sca1_3 and a scan signal Sca2_3 can be applied to control terminals of the switching transistors and the control terminals of sensing transistors located in a third row, respectively, and reference sensing voltages Vsr_3 of driving transistors located in a third row are obtained in a predetermined time duration after applying the scan signal Sca1_3 and the scan signal Sca2_3; further, a scan signal Sca1_4 and a scan signal Sca2_4 can be applied to control terminals of the switching transistors and control terminals of the sensing transistors located in a fourth row, respectively, and reference sensing voltages Vsr_4 of driving transistors located in the fourth row are obtained in a predetermined time duration after applying the scan signal Sca1_4 and the scan signal Sca2_4. For example, the analog-to-digital converter ADC can convert an analog voltage signal obtained by the detection circuit SAMP into a digital signal, for example, dat1, dat2, dat3, and dat4 outputted by the ADC (dat4 is not shown in FIG. 1F) corresponds to Vsr_1, Vsr_2, Vsr_3, and Vsr_4, respectively.

For example, for clarity, FIG. 1F only shows a method of obtaining the reference sensing voltages Vsr_1 to Vsr_4 of the driving transistors located in the first to fourth rows in the predetermined time duration after applying the scan signals. However, after a driving transistors located in a present row are saturated, turn-off sensing voltages (for example, Vb_1 to Vb_4) can also be obtained before a switching transistors and a sensing transistors in a next row are turned on, whereby reference threshold voltages (for example, Vth_1' to Vth_4') of the driving transistors can be obtained.

For example, in a case where the display panel includes more rows of sub-pixel units, switching transistors and sensing transistors in pixel circuits of sub-pixel units in other rows can be turned on row by row, and corresponding reference sensing voltages, turn-off sensing voltages and reference threshold voltages can be obtained, the specific method will not be described here.

It should be noted that, according to actual application requirements, the reference threshold voltage Vth' and the parameter K of the driving transistor of the pixel circuit of the sub-pixel unit can also be obtained during power-off, which can be used to detect the threshold voltage Vth of the driving transistor during the power-on display phase. Here, $K=I/(Vgs-Vth)^2$, I is a saturation current of the driving transistor, and Vgs is a gate-source voltage of the driving transistor, and the specific method is not described here.

For example, as shown in FIG. 1E, detecting the threshold voltage of the driving transistor during the power-on display phase can include step S510 the following.

Step S510: during power-on (for example, a time interval of adjacent display frames), applying a first data voltage Vd1 (Vd1 is equal to Vdr) to the gate electrode of the driving transistor, and in a predetermined time duration (for example, t1-t0) after applying the first data voltage Vd1, obtaining a first sensing voltage Vs1 at the first electrode of the driving transistor, and determining whether the first sensing voltage Vs1 is equal to the reference sensing voltage Vsr.

For example, in a case where the first sensing voltage Vs1 is equal to the reference sensing voltage Vsr, the Vth of the driving transistor is equal to the reference threshold voltage Vth'. For example, as shown in FIG. 1E, in a case where the first sensing voltage Vs1 is not equal to the reference sensing voltage Vsr, the detection method of the threshold voltage of the driving transistor can further include step S520 in the following.

Step S520: during power-on, applying a second data voltage Vd2 different from the first voltage Vd1 to the gate electrode of the driving transistor, and in a predetermined time duration (for example, t1-t0) after applying the second data voltage Vd2, obtaining a second sensing voltage Vs2 at the first electrode of the driving transistor, and determining whether the second sensing voltage Vs2 is equal to the reference sensing voltage Vsr.

For example, in a case where the second sensing voltage Vs2 is equal to the reference sensing voltage Vsr, the Vth of the driving transistor is equal to a value that the reference threshold voltage Vth' plus a difference between the second data voltage Vd2 and the reference data voltage Vdr (i.e., Vth=Vth'+Vd2−Vdr). For example, in a case where the second sensing voltage Vs2 is not equal to the reference sensing voltage Vsr, the detection method of the threshold voltage of the driving transistor can further include step S530 in the following.

Step S530: repeatedly performing step S520 until the second sensing voltage Vs2 is equal to the reference sensing voltage Vsr.

The inventors notes that, a value of the sensing voltage obtained during power-on is influenced by display contents, that is, the sensing voltage obtained by the detection method includes an environmental noise component. Therefore, the threshold voltage of the driving transistor obtained by the above method may deviate from a true value, thereby reducing a brightness uniformity of a display panel and a display device including the pixel circuit. Furthermore, the inventors also notes that the detection of the threshold voltage of the driving transistor during power-on involves detecting the sensing voltages (e.g., the first sensing voltage Vs1 and the second sensing voltage Vs2) multiple times at different times. Therefore, values of environmental noise components included in sensing voltages detected at different times may be different from each other, thereby not only increasing an absolute value of a difference between the threshold voltage of the driving transistor obtained by the above method and the true value, but also prolonging a time required for successive approximation (that is, increasing a number of times of performing step S520) of the second sensing voltage Vs2 and the reference sensing voltage Vsr, which further prolongs a time for detecting the threshold voltage of the driving transistor and reduces the brightness uniformity of the display panel and the display device including the pixel circuit.

Embodiments of the present disclosure provide a detection method of a pixel circuit, a display panel and a driving method thereof. The detection method of the pixel circuit can remove an environmental noise in an initial sensing voltage, thereby improving a threshold compensation effect of the pixel circuit, and further, improving a brightness uniformity of a display panel and a display device including the pixel circuit.

At least one embodiment of the present disclosure provides a detection method of a pixel circuit, the pixel circuit includes a driving transistor, the driving transistor includes a gate electrode and a first electrode, the first electrode of the driving transistor is coupled to a sensing line, and the detection method includes: during a reference charging period, applying a reference data voltage to the gate electrode of the driving transistor to charge the sensing line through the first electrode of the driving transistor, and at a first time duration after applying the reference data voltage, obtaining a benchmark voltage from the sensing line; and during a data charging period, applying a detection data voltage different from the reference data voltage to the gate electrode of the driving transistor to charge the sensing line through the first electrode of the driving transistor, and at the first time duration after applying the detection data voltage, obtaining an initial sensing voltage from the sensing line. A sensing voltage of the pixel circuit is obtained based on at least the benchmark voltage and the initial sensing voltage, and a threshold voltage of the driving transistor is obtained based on the sensing voltage. The detection method of the pixel circuit in the embodiment of the present disclosure can eliminate an adverse effect of environmental noise on the detection of the threshold voltage of the driving transistor.

The following is a non-restrictive description of the detection method of the pixel circuit provided by the embodiment of the present disclosure by way of some examples. As described below, in case of no conflict, different features in these specific examples can be combined with each other to obtain new examples, which also fall within the protection scope of the present disclosure.

Figure 2:
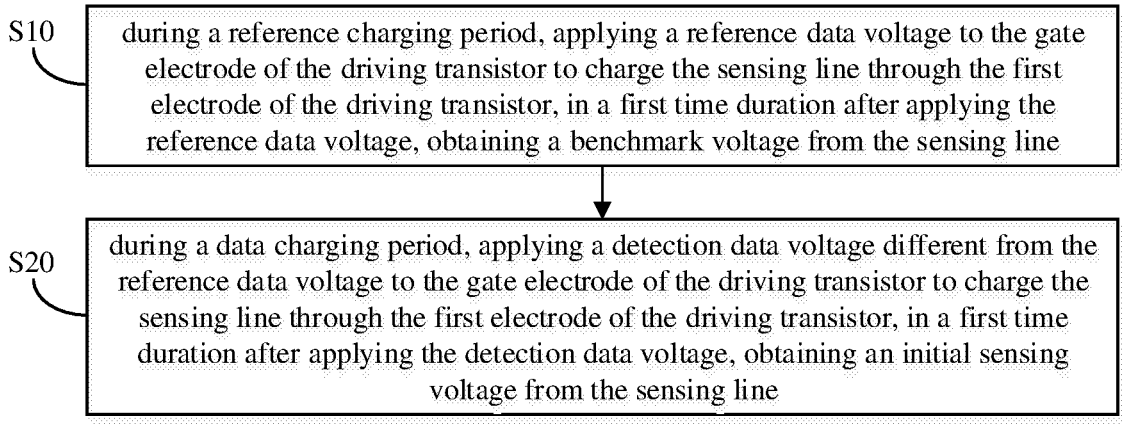
FIG. 2 is an exemplary flowchart of a detection method of a pixel circuit provided by at least one embodiment of the present disclosure.

FIG. 2 illustrates a detection method of a pixel circuit provided by an embodiment of the present disclosure, which is applicable to a sub-pixel unit of a display panel. For example, the display panel can be an organic light emitting diode display panel or other types of display panels, etc., which is not limited thereto by the embodiment of the present disclosure. In the following, the organic light emitting diode display panel is taken as an example for description. The detection method of the pixel circuit can be used to detect a threshold voltage Vth of a driving transistor T3 of the pixel circuit. For example, the detection method can be implemented at least partially in software and loaded and executed by a processor in the display panel, or at least partially implemented in hardware or firmware or the like, so as to remove environmental noise in the initial sensing voltage, thereby improving the threshold compensation effect of the pixel circuit. For example, the detection method of the pixel circuit provided by the embodiment of the present disclosure will be exemplarily described below with reference to a pixel circuit as shown in FIG. 3A and a pixel circuit as shown in FIG. 3B, but the embodiments of the present disclosure are not limited thereto.

Figure 3A:
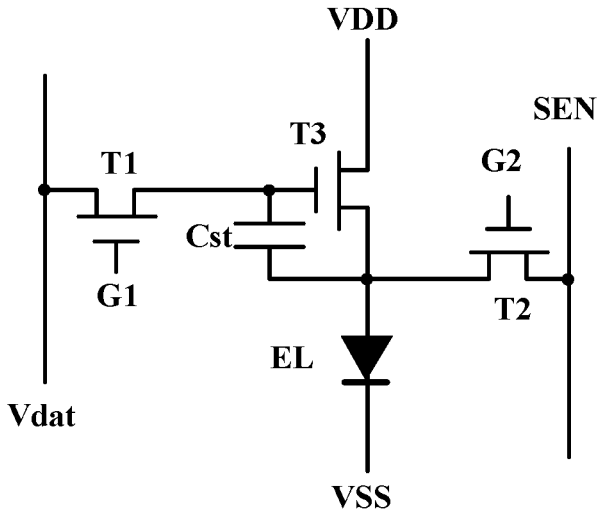
FIG. 3A is a schematic diagram of a pixel circuit.
Figure 3B:
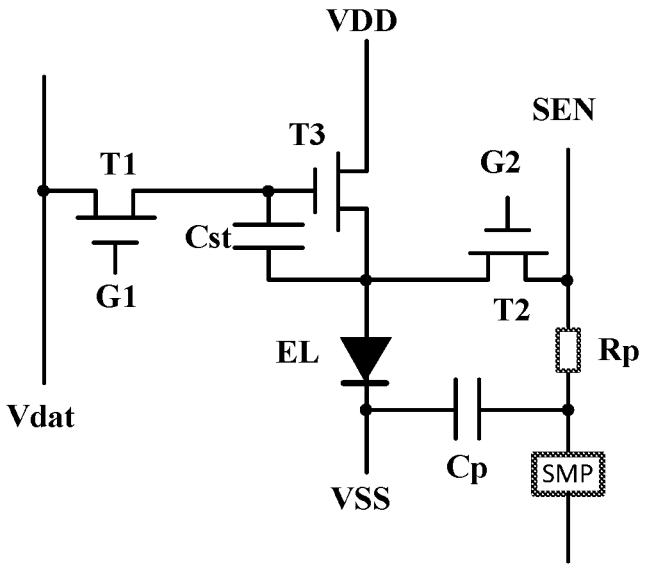
FIG. 3B is a schematic diagram of another pixel circuit.

For example, as shown in FIG. 3A, the pixel circuit includes the driving transistor T3, a light-emitting element EL coupled to a first electrode of the driving transistor, and a sensing line SEN. The driving transistor T3 includes a gate electrode, a first electrode and a second electrode, the first electrode of the driving transistor T3 is connected to the light-emitting element, the second electrode of the driving transistor T3 is coupled to a first power voltage terminal VDD, and the driving transistor is used in the pixel circuit to control an illumination current flowing through the light-emitting element EL. The sensing line SEN is coupled to the first electrode of the driving transistor, and a sensing circuit can obtain a benchmark voltage and an initial sensing voltage at different times through the sensing line SEN. A terminal of the light-emitting element EL is connected to the first electrode of the driving transistor, and another terminal of the light-emitting element EL is connected to a second power voltage terminal VSS. The pixel circuit can apply the reference data voltage and the detection data voltage to the gate electrode of the driving transistor T3 at different times. According to actual application requirements, the pixel circuit can also apply a set voltage (e.g., 0V) to the first electrode (e.g., a source electrode) of the driving transistor T3, to control a state of the driving transistor T3, such as a turned-on state or a turned-off state, or a magnitude of a driving current flowing through the light-emitting element EL. For example, the light-emitting element EL is an organic light emitting diode (OLED), of which a specific structure, color of light, materials being used and the like are not limited by the embodiment of the present disclosure.

For example, as shown in FIG. 3A, the pixel circuit can further include a first transistor T1 and a storage capacitor Cst. The first transistor T1 serves as an input write switch, a gate electrode of the first transistor T1, as a control terminal G1, is connected to a switch scan line (not shown) to receive a scan signal, a first electrode of the first transistor T1 and a second electrode of the first transistor T1 are respectively connected to a signal line Vdat and the gate electrode of the driving transistor T3, to respectively receive a data signal (for example, a reference data voltage or a detection data voltage) and apply the received data signal to the gate electrode of the driving transistor T3. A first terminal of the storage capacitor Cst and a second terminal of the storage capacitor Cst are respectively connected to the gate electrode of the driving transistor T3 and the first electrode of the driving transistor T3, thereby storing the received data signal.

For example, as shown in FIG. 3A, the pixel circuit further includes a second transistor T2. The second transistor T2 serves as a sensing switch, a first electrode of the second transistor T2 is connected to the first electrode of the driving transistor T3, and a second electrode of the second transistor T2 is connected to the sensing line SEN to allow charging the sensing line to form a sensing voltage, and detecting the benchmark voltage and the initial sensing voltage through the sensing line at different times, when the second transistor T2 is turned on; a gate electrode of the second transistor T2, as a control terminal G2, is connected to a sensing scan line (not shown) to receive a sensing control signal.

For example, in a case where the sensing line SEN includes a parasitic capacitance Cvc and a parasitic resistance Rvc, the pixel circuit as shown in FIG. 3A can be equivalent to the pixel circuit as shown in FIG. 3B. The parasitic capacitance Cvc can be charged by a current from the driving transistor T1, so that a voltage on the corresponding sensing line SEN changes. However, the embodiments of the present disclosure are not limited thereto, and in addition to using the parasitic capacitance Cvc on the sensing line SEN, a sensing capacitor can also be separately provided, of which a terminal is connected to the sensing line SEN and another terminal is connected to, for example, a fixed voltage (e.g., a grounded voltage), so as to assist in implementing the detection method of the embodiment of the present disclosure.

For example, a terminal of the sensing line SEN is further connected to a detection circuit, and the detection circuit obtains a voltage (e.g., a benchmark voltage) on the sensing line SEN at a specific time (e.g., time t1) based on a sampling signal. For example, according to actual application requirements, an output terminal of the detection circuit is connected to an analog-to-digital converter ADC (not shown in FIG. 3A and FIG. 3B), and an analog signal outputted by the detection circuit is sent into the analog-to-digital converter ADC, and therefore a corresponding digital signal can be obtained for subsequent processing. For example, according to actual application requirements, the output terminal of the detection circuit is also connected to an amplification circuit, and the analog signal outputted by the detection circuit is amplified and then sent to the analog-to-digital converter ADC.

In the above embodiments as shown in FIG. 3A and FIG. 3B, the driving transistor T3 is an N-type transistor, the first power voltage terminal VDD is a high voltage terminal (e.g., supplying a high level), and the second power voltage terminal VSS is a low voltage terminal (e.g., supplying a low level, which is lower than the high level of the aforementioned high voltage terminal, such as a grounded voltage). Correspondingly, the first electrode of the driving transistor T3 is a source electrode, which is connected to the light-emitting element EL; the second electrode of the driving transistor T3 a drain electrode, which is connected to the first power voltage terminal VDD to receive a first power voltage. In addition, the first transistor T1 and the second transistor T2 are also N-type transistors, but the embodiments of the present disclosure are not limited thereto. For example, the first transistor T1 and/or the second transistor T2 can be P-type transistors, and accordingly, the polarity of control signals applied to the gate electrode of the first transistor T1 and the gate electrode of the second transistor T2 can be changed. And for example, the driving transistor T3 can also be a P-type transistor, and can still be coupled to the sensing line through a source electrode (a first electrode) of the P-type driving transistor for performing detection operation.

Figure 4A:
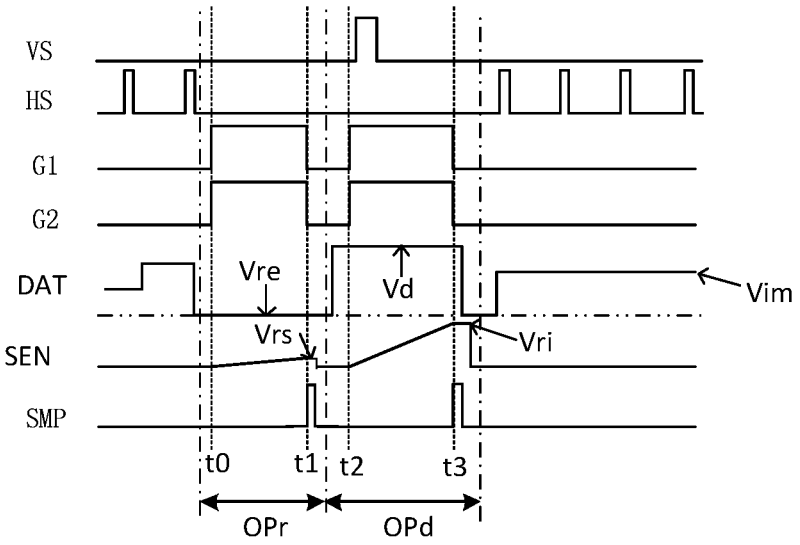
FIG. 4A is a driving timing schematic diagram of the pixel circuit as shown in FIG. 3B.

For example, as shown in FIG. 4A, based on the pixel circuit as shown in FIG. 3A or FIG. 3B, the detection method of the pixel circuit provided by an embodiment of the present disclosure includes the following steps.

Step S10: during a reference charging period, applying a reference data voltage to the gate electrode of the driving transistor to charge the sensing line through the first electrode of the driving transistor, and at a first time duration after applying the reference data voltage, obtaining a benchmark voltage from the sensing line.

Step S20: during a data charging period, applying a detection data voltage different from the reference data voltage to the gate electrode of the driving transistor to charge the sensing line through the first electrode of the driving transistor, and at the first time duration after applying the detection data voltage, obtaining an initial sensing voltage from the sensing line.

For example, in the process of detecting the threshold voltage Vth of the driving transistor T3 of the pixel circuit, each detecting operation of the sensing voltage can include step S10 and step S20, but the embodiments of the present disclosure are not limited thereto; and for example, according to actual application requirements, only the sensing voltage detection in a latter phase of the successive approximation process may include step S10 and step S20, while the sensing voltage detection in a former phase of the successive approximation process may include only step S20.

For example, in step S10, a high-level signal can be applied to the gate electrode of the first transistor T1 and the gate electrode of the second transistor T2 at time t0, and the first transistor T1 and the second transistor T2 can be turned on, so that a reference data voltage Vre provided by the signal line Vdat can be applied to the gate electrode of the driving transistor T3, so that the driving transistor T3 is turned on, and further, the sensing line SEN can be charged through the first electrode of the driving transistor T3; then, at the first time duration (i.e., t1-t0) after applying the reference data voltage Vre, a benchmark voltage Vrs can be obtained from the sensing line SEN, and the benchmark voltage Vrs can represent an influence of environmental factors (e.g., temperature or/and display content) on the voltage obtained from the sensing line SEN. For example, the reference data voltage Vre can be zero (i.e., the same as the grounded voltage of the entire system), but the embodiments of the present disclosure are not limited thereto.

For example, according to actual application requirements, in an example, the first transistor T1 and the second transistor T2 can be turned off before the benchmark voltage Vrs is obtained from the sensing line SEN (e.g., at time t1), thereby avoiding a voltage fluctuation on the sensing line when the benchmark voltage Vrs is detected, and further, improving accuracy of the benchmark voltage Vrs obtained in the detection. Alternatively, in another example, the detection can be performed while the second transistor T2 is still in a turn-on state, and the benchmark voltage Vrs can be obtained from the sensing line SEN.

For example, as shown in FIG. 4A, in a time period after the first transistor T1 is turned on and before the benchmark voltage Vrs is obtained, the reference data voltage Vre is continuously applied to the gate electrode of the driving transistor T3, to maintain the voltage of the gate electrode of the driving transistor T3, but the embodiments of the present disclosure are not limited thereto.

For example, in step S20, a high-level signal can be applied to the gate electrode of the first transistor T1 and the gate electrode of the second transistor T2 at time t2, and the first transistor T1 and the second transistor T2 can be turned on again, so that a detection data voltage Vd different from the reference data voltage Vre provided by the signal line Vdat can be applied to the gate electrode of the driving transistor T3, so that the driving transistor T3 is turned on, and further the sensing line SEN can be charged through the first electrode of the driving transistor T3; then, at the first time duration (i.e., t3-t2) after applying the detection data voltage Vd, an initial sensing voltage Vri can be obtained from the sensing line SEN. And t3-t2 can be identical to t1-t0, so that the benchmark voltage Vrs can be closer to an environmental noise component in the initial sensing voltage Vri. For example, the detection data voltage Vd can be the same as a data voltage applied in a sensing voltage detection operation.

For example, as shown in FIG. 4A, in an example, the first transistor T1 and the second transistor T2 can be turned off before the initial sensing voltage Vri is obtained from the sensing line SEN (for example, at time t3), thereby avoiding a voltage fluctuation on the sensing line SEN when detecting the initial sensing voltage Vri, and further improving accuracy of a value of the initial sensing voltage Vri obtained in the detection. Alternatively, in another example, the detection can be performed while the second transistor T2 is still in a turn-on state, and the initial sensing voltage Vri can be obtained from the sensing line SEN.

For example, as shown in FIG. 4A, in a time period after the first transistor T1 is turned on and before the initial sensing voltage Vri is obtained, the detection data voltage Vd can be continuously applied to the gate electrode of the driving transistor T3, to maintain the voltage of the gate electrode of the driving transistor T3, but the embodiments of the present disclosure are not limited thereto.

Then, a sensing voltage Vs of the pixel circuit can be obtained based on the benchmark voltage Vrs and the initial sensing voltage Vri. For example, the sensing voltage Vs of the pixel circuit is equal to a difference between the initial sensing voltage Vri and the benchmark voltage Vrs, that is, Vs=Vri−Vrs, but the embodiments of the present disclosure are not limited thereto. Because the benchmark voltage Vrs represents an environmental noise component, the sensing voltage Vs obtained by the above method removes the environmental noise component (i.e., the benchmark voltage Vrs) in the initial sensing voltage Vri resulting from environmental factors (i.e., temperature or/and display content), so that the obtained sensing voltage Vs, in which the environmental noise in the initial sensing voltage is removed, is closer to a true value, thereby improving a threshold compensation effect of the pixel circuit and improving brightness uniformity of a display panel and a display device including the pixel circuit.

For example, the first time duration can be set according to actual application requirements, which is not specifically limited by the embodiments of the present disclosure. For example, the benchmark voltage Vrs and the initial sensing voltage Vri can be detected before the driving transistor T3 is completely turned off by setting the first time duration, but the embodiments of the present disclosure are not limited thereto. For example, in a case where the substantially accurate benchmark voltage Vrs and the initial sensing voltage Vri can be obtained, the first time duration can be as short as possible, thereby reducing a detection time of the sensing voltage and improving a detection efficiency.

It should be noted that a voltage variation of the sensing line SEN as shown in FIG. 4A during charging (e.g., from time t0 to time t1) follows a linear variation rule, but the embodiments of the present disclosure are not limited thereto; for example, according to actual applications requirements, the voltage variation of the sensing line SEN during charging can follow the following variation rule, that is, a voltage variation rate gradually decreases with an increase of time (for example, referring to FIG. 1E).

For example, the display panel including the pixel circuit can include a plurality of display periods, each of which is used to display a frame of image, and during displaying image, a signal line DAT can apply different data voltages Vim to driving transistors T3 of the pixel circuits in different sub-pixel units according to actual needs, so that different driving transistors T3 have different turn-on degrees, and different light-emitting elements EL have different luminance, thereby different sub-pixel units displaying different grayscales. In order to coordinate the image display, a control circuit of the display panel triggers a display operation by using a horizontal synchronization signal HS and a vertical synchronization signal VS.

For example, a time length for display a frame of image is equal to a time required from displaying a first row of sub-pixel units of the frame of image to displaying a last row of sub-pixel units of the frame of image. For example, a predetermined interval (time interval) can be set between adjacent display periods (i.e., adjacent display frames). For example, a blanking time can be set between adjacent display periods, and the predetermined interval can be at least part of the blanking time.

For example, the reference charging period OPr and the data charging period OPd are both in a same predetermined interval, thereby avoiding errors caused by changes in environmental factors (for example, electron mobility), and further, improving accuracy of the detection result. For example, the reference charging period OPr can be located before the data charging period OPd, but the embodiments of the present disclosure is not limited thereto. The reference charging period OPr can also be located after the data charging period OPd according to actual application requirements.

For example, according to actual application requirements, the detection method of the pixel circuit provided by the embodiments of the present disclosure includes step S30 in the following.

Step 30: during a supplementary reference charging period, applying the reference data voltage to the gate electrode of the driving transistor to charge the sensing line through the first electrode of the driving transistor, and at the first time duration after applying the reference data voltage, obtaining a supplementary benchmark voltage from the sensing line.

Figure 4B:
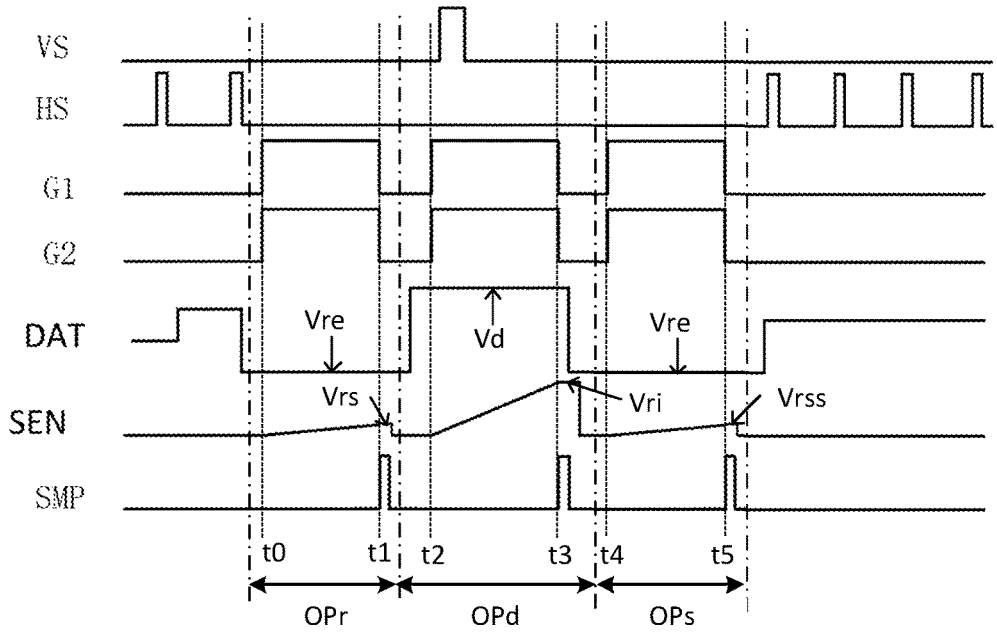
FIG. 4B is another driving timing schematic diagram of the pixel circuit as shown in FIG. 3B.

For example, as shown in FIG. 4B, in the supplementary reference charging period Ops, a high-level signal can be applied to the gate electrode of the first transistor T1 and the gate electrode of the second transistor T2 at time t4, and the first transistor T1 and the second transistor T2 can be turned on, whereby the reference data voltage Vre provided by the signal line Vdat can be applied to the gate electrode of the driving transistor T3, so that the driving transistor T3 is turned on, and further, the sensing line SEN can be charged through the first electrode of the driving transistor T3; then, at the first time duration (i.e., t5-t4) after applying the reference data voltage Vre, the supplementary benchmark voltage Vrss can be obtained from the sensing line SEN; and the supplementary benchmark voltage Vrss can represent an influence of environmental factors (e.g., environmental noise factors such as temperature or/and display content, etc.) on the voltage obtained from the sensing line SEN.

Thereafter, the sensing voltage Vs of the pixel circuit can be obtained based on the benchmark voltage Vrs, the supplementary benchmark voltage Vrss and the initial sensing voltage Vri. The sensing voltage Vs of the pixel circuit can be equal to, for example, a difference between the initial sensing voltage Vri and an average of the benchmark voltage Vrs and the supplementary benchmark voltage Vrss, that is, Vs=Vri−(Vrs+Vrss)/2. And t5-t4 can be identical to t3-t2 and t1-t0, so that the supplementary benchmark voltage Vrss can be closer to the environmental noise component in the initial sensing voltage Vri, but the embodiments of the present disclosure are not limited thereto. Because both the supplementary benchmark voltage Vrss and the benchmark voltage Vrs represent the environmental noise component, the initial sensing voltage Vri subtracts the average of the supplementary benchmark voltage Vrss and the benchmark voltage Vrs, that is, subtracts the influence of the environmental noise on the voltage, thereby improving the accuracy of the sensing voltage Vs.

For example, by setting the supplementary reference charging period Ops, the influence of environmental factors on the voltage obtained from the sensing line SEN can be measured multiple times at different times, whereby a more accurate environmental noise component can be obtained, and further, the obtained sensing voltage Vs can be closer to the true value.

For example, the reference charging period OPr, the supplementary reference charging period OPs, and the data charging period OPd can be all in a same predetermined interval, and the supplementary reference charging period Ops can be located after the data charging period OPd, but the embodiments of the present disclosure are not limited thereto.

For example, by setting the reference charging period OPr and the supplementary reference charging period Ops at different two sides of the data charging period OPd, the obtained sensing voltage Vs can still be close to the true value, even in a case where the environmental factors fluctuate during the data charging period, thereby improving a threshold compensation effect of the pixel circuit and improving brightness uniformity of a display panel and a display device including the pixel circuit.

For example, as shown in FIG. 4A, a time length of the reference charging period OPr, a time length of the supplementary reference charging period OPs, and a time length of the data charging period OPd are greater than a turn-on time of the first transistor T1 and the second transistor T2 in the corresponding charging period, respectively.

It should be noted that the time length of the reference charging period OPr, the time length of the supplementary reference charging period OPs, and the time length of the data charging period OPd may be different. For example, the time length of the data charging period OPd can be greater than the time length of the reference charging period OPr and the time length of the supplementary reference charging period Ops, but the embodiments of the present disclosure are not limited thereto; also, for example, the time length of the reference charging period OPr, the time length of the supplementary reference charging period OPs, and the time length of the data charging period OPd may be equal.

It should be further noted that, in the embodiments of the present disclosure, the flow of the detection method of the pixel circuit may include more or less operations, and these operations can be performed sequentially or in parallel. Although the flow of detection method described above includes a plurality of operations in a specific order, it should be clearly understood that the order of the plurality of operations is not limited. The detection method described above may be performed once or may be performed a plurality of times according to predetermined conditions.

Figure 5:
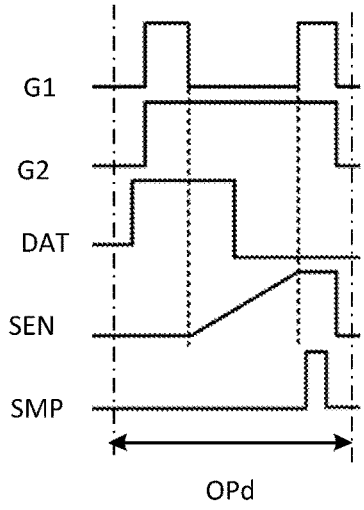
FIG. 5 is still another driving timing schematic diagram of the pixel circuit as shown in FIG. 3B.

For example, FIG. 5 is still another driving timing schematic diagram of the pixel circuit as shown in FIG. 3B, and the timing schematic diagram as shown in FIG. 5 is similar to the driving timing schematic diagram as shown in FIG. 4A. For the sake of clarity, FIG. 5 only shows a driving timing schematic diagram of the pixel circuit during the data charging period OPd, and the driving timing schematic diagram during the reference charging period OPr can be obtained by referring to the timing schematic diagram as shown in FIG. 5 and the timing schematic diagram as FIG. 4A, and details are not described herein again.

For example, as shown in FIG. 5, during the data charging period OPd, the first transistor T1 is turned off after applying the detection data voltage Vd to the gate electrode of the driving transistor T3, and then the first transistor T1 is re-turned on before obtaining the initial sensing voltage Vri; after the first transistor T1 is re-turned on, the voltage supplied from the signal line DAT to the gate electrode of the driving transistor T3 is converted from the detection data voltage Vd to a second detection data voltage Vd having a voltage value less than the detection data voltage Vd, thereby ensuring that the driving transistor T3 is in a turn-off state, and the voltage of the first electrode of the driving transistor T3 is no longer changed. For example, the second detection data voltage Vd is zero, but the embodiments of the present disclosure are not limited thereto.

For example, because the voltage of the gate electrode of the driving transistor T3 is the second detection data voltage Vd after the first transistor T1 is re-turned on, a difference (i.e., Vgs) between the second detection data voltage Vd and the voltage of the first electrode of the driving transistor T3 is less than the threshold voltage of the driving transistor T3, so that the driving transistor T3 is turned off, at which time the voltage of the first electrode of the driving transistor T3 and the voltage of the sensing line SEN will no longer increase, and therefore, the second transistor T2 is not needed to be turned off when detecting the initial sensing voltage Vri, thereby avoiding a deviation of the initial sensing voltage Vri obtained in the detection from its true value, which is caused by a pull-down effect of the second transistor T2, and further, the obtained sensing voltage Vs being closer to the true value.

At least an embodiment of the present disclosure also provides a driving method of a display panel, a sub-pixel unit of the display panel includes a pixel circuit and a sensing line, the pixel circuit includes a driving transistor, the driving transistor includes a gate electrode and a first electrode, the sensing line is coupled to the first electrode of the driving transistor, and the driving method includes: performing the detection method provided by any one of the embodiments of the present disclosure on the pixel circuit, to obtain a threshold voltage of the driving transistor of the pixel circuit.

Figure 6:
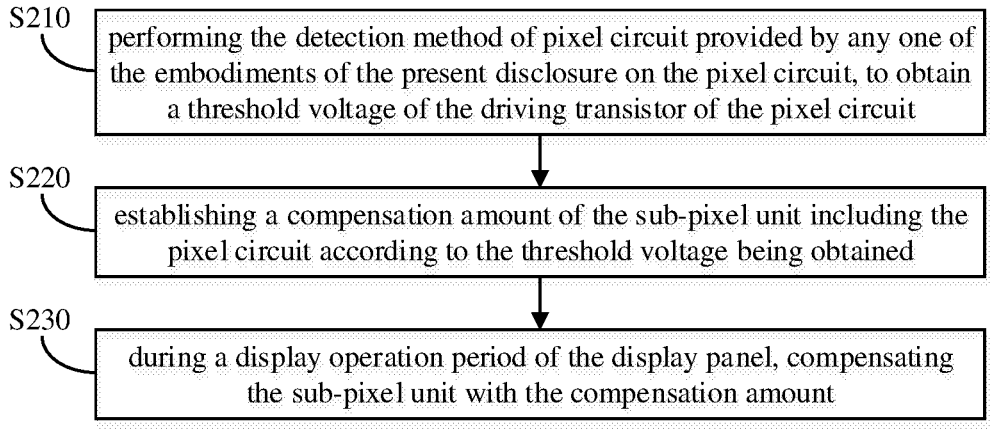
FIG. 6 is an exemplary flowchart of a driving method of a display panel provided by at least one embodiment of the present disclosure.

The display panel includes a plurality of sub-pixel units, each of which can include a pixel circuit. The plurality of sub-pixel units included in the display panel can be arranged, for example, in an array, and accordingly, pixel circuits can be arranged for example, in an array. Light emitted from light-emitting elements of different sub-pixel units can be different in color, therefore, the display panel can realize to a color display. For example, the pixel circuit included in the display panel can be the pixel circuit as shown in FIG. 3A or the pixel circuit as FIG. 3B. For example, as shown in FIG. 6, the driving method of the display panel provided by the present embodiment includes step S210.

Step S210: performing the detection method provided by any one of the embodiments of the present disclosure on the pixel circuit, to obtain a threshold voltage of the driving transistor of the pixel circuit.

For example, the detection method of the pixel circuit can be referred to the embodiment as shown in FIG. 2, and details are not described herein again. For example, according to actual application requirements, the driving method of the display panel provided by the present embodiment further includes step S220 and step S230.

Step S220: establishing a compensation amount of the sub-pixel unit including the pixel circuit according to the threshold voltage being obtained.

Step S230: during a display operation period of the display panel, compensating the sub-pixel unit with the compensation amount.

For example, in an example, firstly, threshold voltages of driving transistors of pixel circuits of the sub-pixel units can be detected row by row, and detection results can be stored; then, after the threshold voltages of the driving transistors of the pixel circuits of all the sub-pixel units of the display panel are obtained, a compensation amount can be established for each sub-pixel unit including the pixel circuit; and finally, during the display operation period of the display panel, a corresponding threshold compensation operation is performed on each sub-pixel unit of the display panel based on the established compensation amount. Therefore, a cycle of threshold compensation can be completed. These compensation amounts can be saved in a form of a look-up table, which can be stored in a memory of a driving device, for ease of recalling or updating.

For example, firstly, the detection method of the pixel circuit provided by any one of the embodiments of the present disclosure can be performed on pixel circuits of sub-pixel units in a first row, and threshold voltages of driving transistors of the pixel circuits of the sub-pixel units in the first row can be obtained; then, the detection method of the pixel circuit provided by any one of the embodiments of the present disclosure can be performed on pixel circuits of sub-pixel units in a second row, and threshold voltages of driving transistors of the pixel circuits of the sub-pixel units in the second row can be obtained; next, pixel circuits of sub-pixel units in other rows of the display panel can be detected row by row, until threshold voltages of driving transistors of the pixel circuits of all the sub-pixel units of the display panel are obtained; and finally, a compensation amount can be established for each sub-pixel unit including the pixel circuit, and a threshold compensation operation is performed on each sub-pixel unit of the display panel based on the established compensation amount in a subsequent display operation.

It should be noted that other indispensable steps of the driving method of the display panel can be referred to a driving method of the display panel, which should be understood by those skilled in the art, and details will not be described herein.

For example, the driving method of the display panel provided by the present embodiment can remove the environmental noise component in the initial sensing voltage, so that the obtained sensing voltage and the threshold voltage of the driving transistor are closer to true values, thereby improving the compensation effect and brightness uniformity of the display panel using the driving method.

At least an embodiment of the present disclosure also provides a display panel, the display panel includes a pixel circuit, a sensing line and a control circuit, the pixel circuit includes a driving transistor, the driving transistor includes a gate electrode and a first electrode, the sensing line is coupled to the first electrode of the driving transistor; and the control circuit is configured to perform the detection method provided by any one of the embodiments of the present disclosure or the driving method of the display panel provided by any one of the embodiment of the present disclosure.

For example, the display panel 10 includes a pixel circuit and a control circuit 120. The pixel circuit can be, for example, the pixel circuit as shown in FIG. 3A or the pixel circuit as FIG. 3B. For example, the display panel provided by the present embodiment is specifically described by taking a case that the pixel circuit in the display panel of the present embodiment is implemented as the pixel circuit as shown in FIG. 3A as an example, but the embodiment of the present disclosure is not limited thereto.

Figure 7A:
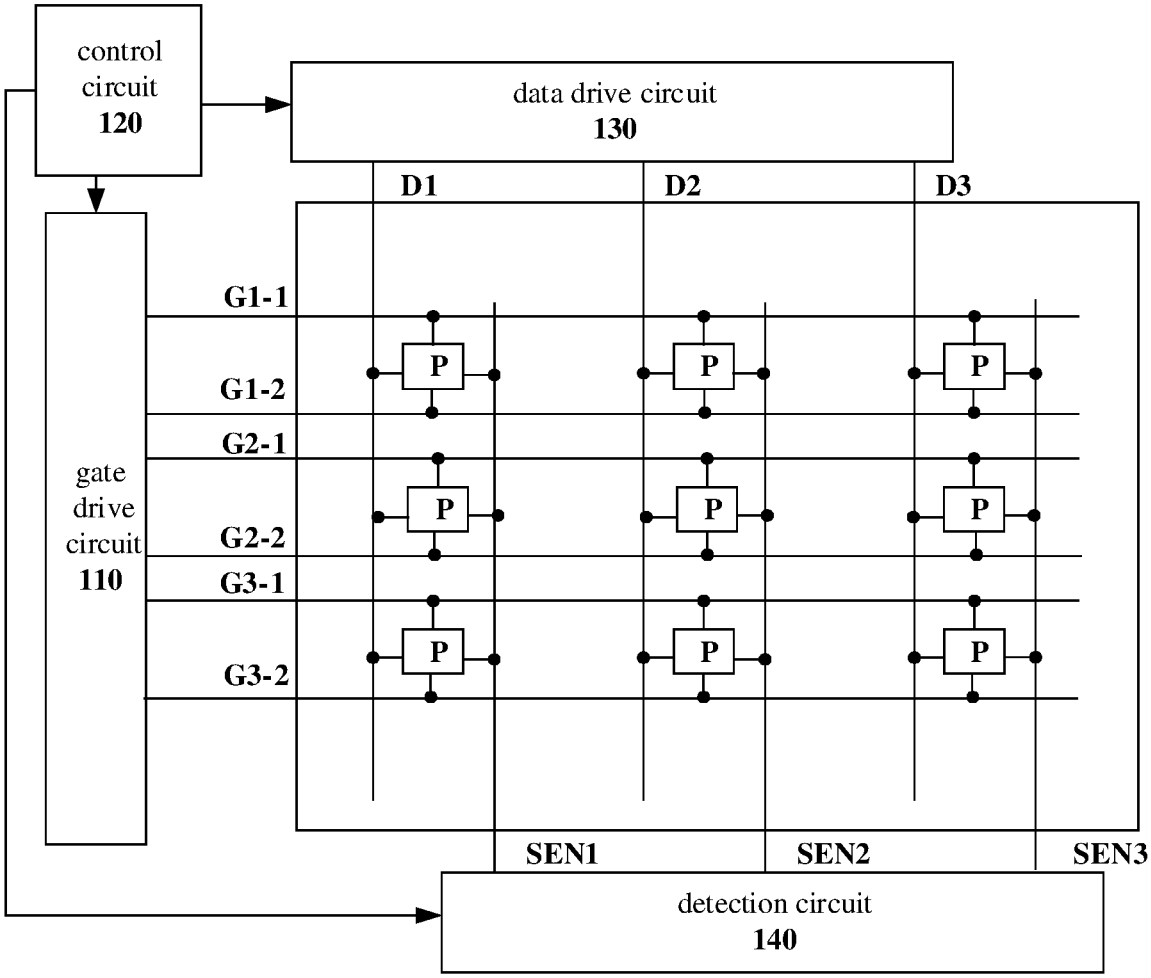
FIG. 7A is a schematic diagram of a display panel provided by at least one embodiment of the present disclosure.
Figure 7B:
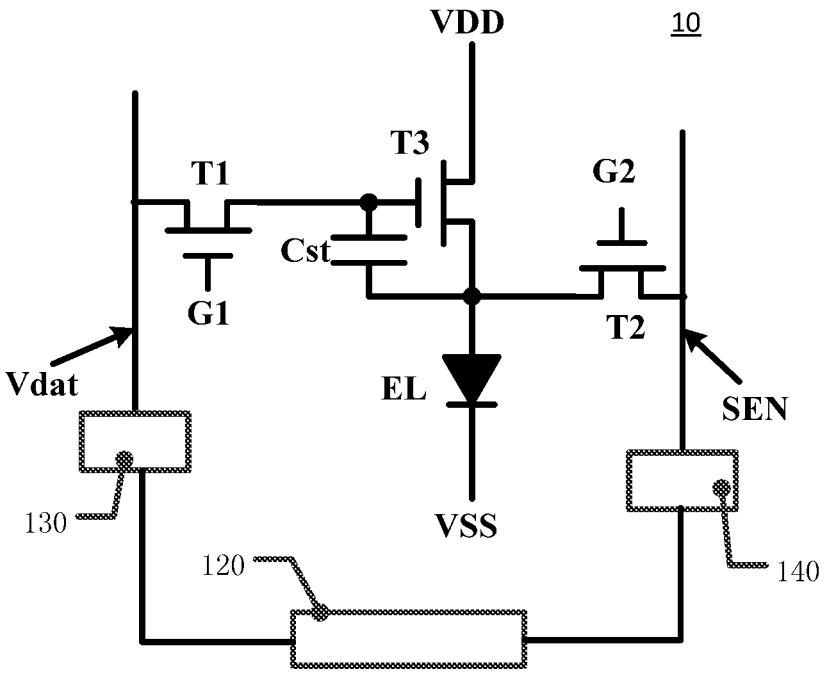
FIG. 7B is a schematic diagram of a display panel (including a sub-pixel unit) provided by at least one embodiment of the present disclosure.

For example, FIG. 7A is a schematic diagram of a display panel provided by an embodiment of the present disclosure. For example, as shown in FIGS. 7A and 7B, the display panel includes sub-pixel units P, sensing lines SEN (e.g., SEN1, SEN2, SEN3, etc.), and scan lines (e.g., G1-1, G1-2, G2-1, G2-2, G3-1, G3-2, etc.), data lines (e.g., D1, D2, D3, etc.), a gate drive circuit 110, a control circuit 120, a data drive circuit 130, and a detection circuit 140. For example, the scan lines G1-1, G2-1, and G3-1 are respectively connected to control terminals G1 of first transistors of pixel circuits of sub-pixel units P in the first row, the second row, and a third row, and the scan lines G1-2, G2-2 and G3-2 are respectively connected to control terminals G2 of second transistors of the pixel circuits of the sub-pixel units in the first row, the second row, and the third row.

For example, as shown in FIG. 7A and FIG. 7B, the sub-pixel units P in a display area of the display panel includes the pixel circuits, and a control circuit 120 is in a peripheral area of the display panel outside the display area. The pixel circuit includes a driving transistor, the driving transistor includes a gate electrode and a first electrode, and the sensing line SEN is coupled to the first electrode of the driving transistor. For example, the control circuit 120 is configured to perform the detection method provided by any one of the embodiments of the present disclosure or the driving method of the display panel provided by any one of the embodiment of the present disclosure. For example, a specific implementation manner of the detection method in the present embodiment can be referred to the embodiment as shown in FIG. 2, and details are not described herein again.

For example, the control circuit 120 is also configured to control the gate drive circuit 110, the data drive circuit 130, and the detection circuit 140. For example, the data drive circuit 130 is configured to provide a reference data voltage and a detection data voltage at different times according to actual application requirements. The gate drive circuit 110 is configured to provide a scan signal of the first transistor and a scan signal of the second transistor, thereby controlling turn-on and turn-off of the first transistor and the second transistor.

For example, the pixel circuit is further configured to receive the reference data voltage and the detection data voltage, and apply the reference data voltage and the detection data voltage to the gate electrode of the driving transistor at different times. For example, the detection circuit 140 is configured to read a benchmark voltage and an initial sensing voltage from the sensing line SEN.

For example, the pixel circuit further includes a second switching transistor T2, and the light-emitting element EL can be, for example, an organic light emitting diode, but the embodiments of the present disclosure are not limited thereto. For example, a second electrode of the driving transistor and a first electrode of the driving transistor can be configured to be connected to a first power voltage terminal VDD and a first electrode of the light-emitting element EL, respectively, and a second electrode of the light-emitting element EL is connected to a second power voltage terminal VSS. For example, a first electrode of the second switching transistor T2 is electrically connected to the first electrode of the driving transistor, and a second electrode of the second switching transistor T2 is electrically connected to the detection circuit 140. For example, the pixel circuit further includes a sensing line SEN, and the sensing line SEN electrically connects the second electrode of the second switching transistor T2 and the detection circuit 140.

For example, the pixel circuit further includes a first transistor T1 and a storage capacitor Cst. The first transistor T1 is configured to obtain a data signal from the data drive circuit 130, and write the data signal to the gate electrode of the driving transistor, and the storage capacitor Cst stores the data signal. For example, the pixel circuit can further include a signal line Vdat, and a first electrode of the first transistor T1 is connected to the signal line Vdat.

For example, in an example, the control circuit 120 is a timing controller (T-CON). In another example, the control circuit 120 can further include a processor (not shown) and a storage (not shown), the storage includes executable code and data required by running the code or data being generated, the processor executes the executable code to perform the detection method provided by any one of the embodiments of the present disclosure or the driving method of the display panel provided by any one of the embodiments of the present disclosure.

For example, the processor may be a central processing unit (CPU) or other processing units with a data processing ability and/or instruction execution ability. For example, the processor can be implemented as a general purpose processor, and can also be a single chip microcomputer, a microprocessor, a digital signal processor, a dedicated image processing chip, or a field programmable gate array. The storage can include, for example, a volatile storage and/or a non-volatile storage, and can include, for example, a read only memory (ROM), a hard disk, a flash memory, etc. Accordingly, the storage can be implemented as one or a plurality of computer program productions, and the computer program productions can include computer-readable storages media in various forms, on which one or a plurality of executable code (e.g., computer program instructions) can be stored. The processor can run the program instructions to perform the detection method provided by any one of the embodiments of the present disclosure, thereby obtaining the threshold voltage of the driving transistor of the pixel circuit included by the display panel, and further, realizing a threshold compensation function of the display panel. For example, the storage can also store other various applications and various data, such as initial threshold voltage of each pixel circuit, and various data used and/or generated by the applications.

For example, the display panel provided by the present embodiment can remove the environmental noise component of the initial sensing voltage, the obtained sensing voltage and the threshold voltage of the driving transistor are closer to true values, thereby improving the compensation effect and brightness uniformity of the display panel.

The following statements should be noted:

(1) The accompanying drawings involve only the structure(s) in connection with the embodiment(s) of the present disclosure, and other structure(s) can be referred to common design(s).

(2) In case of no conflict, features in an embodiment or in different embodiments can be combined.

Although the present disclosure has been described in detail with general description and specific embodiments above, some modifications or improvements can be performed on the basis of the embodiments of the present disclosure, which is obvious to those skilled in the art. Therefore, those modifications or improvements performed without departing from the spirit of the present disclosure fall within the protection scope required by the present disclosure.

What have been described above are only specific implementations of the present disclosure, the protection scope of the present disclosure is not limited thereto. Therefore, the protection scope of the present disclosure should be based on the protection scope of the claims.

What is claimed is:

1. A detection method of a pixel circuit, the pixel circuit comprising a driving transistor, the driving transistor comprising a gate electrode and a first electrode, the first electrode of the driving transistor being coupled to a sensing line, the detection method comprising:

during a reference charging period, applying a reference data voltage to the gate electrode of the driving transistor to charge the sensing line through the first electrode of the driving transistor, and at a first time duration after applying the reference data voltage, obtaining a benchmark voltage from the sensing line; and during a data charging period, applying a detection data voltage different from the reference data voltage to the gate electrode of the driving transistor to charge the sensing line through the first electrode of the driving transistor, and at the first time duration after applying the detection data voltage, obtaining an initial sensing voltage from the sensing line;

wherein a sensing voltage of the pixel circuit is obtained based on at least the benchmark voltage and the initial sensing voltage, and a threshold voltage of the driving transistor is obtained based on the sensing voltage;

wherein a predetermined interval is set between adjacent display frames; and the reference charging period and the data charging period are both in a same predetermined interval;

wherein the reference charging period is before the data charging period;

the detection method further comprises:

during a supplementary reference charging period, applying the reference data voltage to the gate electrode of the driving transistor to charge the sensing line through the first electrode of the driving transistor, and at the first time duration after applying the reference data voltage, obtaining a supplementary benchmark voltage from the sensing line;

wherein the reference charging period, the supplementary reference charging period and the data charging period are all in a same predetermined interval, and the supplementary reference charging period is after the data charging period; and the sensing voltage of the pixel circuit is obtained based on the benchmark voltage, the supplementary benchmark voltage and the initial sensing voltage.

2. The detection method according to claim 1, wherein the reference data voltage is zero.

3. The detection method according to claim 2, wherein the sensing voltage of the pixel circuit is equal to a difference between the initial sensing voltage and the benchmark voltage.

4. The detection method according to claim 2, wherein a predetermined interval is set between adjacent display frames; and the reference charging period and the data charging period are both in a same predetermined interval.

5. The detection method according to claim 2, wherein the pixel circuit further comprises a first transistor and a storage capacitor, a first electrode of the first transistor and a second electrode of the first transistor are respectively connected to a signal line and the gate electrode of the driving transistor, a first terminal of the storage capacitor and a second terminal of the storage capacitor are respectively connected to the gate electrode of the driving transistor and the first electrode of the driving transistor;

the detection method further comprises:

during the reference charging period, turning on the first transistor to continuously apply the reference data voltage to the gate electrode of the driving transistor in a time period before obtaining the benchmark sensing voltage; and during the data charging period, turning on the first transistor to continuously apply the detection data voltage to the gate electrode of the driving transistor in a time period before obtaining the initial sensing voltage.

6. The detection method according to claim 1, wherein the sensing voltage of the pixel circuit is equal to a difference between the initial sensing voltage and the benchmark voltage.

7. The detection method according to claim 6, wherein a predetermined interval is set between adjacent display frames; and the reference charging period and the data charging period are both in a same predetermined interval.

8. The detection method according to claim 1, wherein the sensing voltage of the pixel circuit is equal to a difference between the initial sensing voltage and an average of the benchmark voltage and the supplementary benchmark voltage.

9. The detection method according to claim 1, wherein the pixel circuit further comprises a first transistor and a storage capacitor, a first electrode of the first transistor and a second electrode of the first transistor are respectively connected to a signal line and the gate electrode of the driving transistor, a first terminal of the storage capacitor and a second terminal of the storage capacitor are respectively connected to the gate electrode of the driving transistor and the first electrode of the driving transistor;

the detection method further comprises:

during the reference charging period, turning on the first transistor to continuously apply the reference data voltage to the gate electrode of the driving transistor in a time period before obtaining the benchmark sensing voltage; and during the data charging period, turning on the first transistor to continuously apply the detection data voltage to the gate electrode of the driving transistor in a time period before obtaining the initial sensing voltage.

10. The detection method according to claim 9, wherein the pixel circuit further comprises a second transistor, a first electrode of the second transistor is connected to the first electrode of the driving transistor, and a second electrode of the second transistor is connected to the sensing line;

the detection method further comprises:

turning off the first transistor and the second transistor before obtaining the initial sensing voltage.

11. The detection method according to claim 1, wherein the pixel circuit further comprises a first transistor and a storage capacitor, a first electrode of the first transistor and a second electrode of the first transistor are respectively connected to a signal line and the gate electrode of the driving transistor, a first terminal of the storage capacitor and a second terminal of the storage capacitor are respectively connected to the gate electrode of the driving transistor and the first electrode of the driving transistor;

the detection method further comprises:

during the data charging period, turning off the first transistor after applying the detection data voltage to the gate electrode of the driving transistor, and re-turning on the first transistor before obtaining the initial sensing voltage; and during the turning off of the first transistor, a voltage supplied from the signal line to the gate electrode of the driving transistor is converted from the detection data voltage to a second detection data voltage having a voltage value less than the detection data voltage.

12. The detection method according to claim 11, wherein the second detection data voltage is zero.

13. The detection method according to claim 1, wherein a second electrode of the driving transistor is coupled to a first power voltage terminal to receive a first power voltage.

14. A driving method of a display panel, the display panel comprising a pixel circuit and a sensing line, the pixel circuit comprising a driving transistor, the driving transistor comprising a gate electrode and a first electrode, the sensing line being coupled to the first electrode of the driving transistor, the driving method comprising:

during a reference charging period, applying a reference data voltage to the gate electrode of the driving transistor to charge the sensing line through the first electrode of the driving transistor, and at a first time duration after applying the reference data voltage, obtaining a benchmark voltage from the sensing line; and during a data charging period, applying a detection data voltage different from the reference data voltage to the gate electrode of the driving transistor to charge the sensing line through the first electrode of the driving transistor, at the first time duration after applying the detection data voltage, obtaining an initial sensing voltage from the sensing line;

wherein a sensing voltage of the pixel circuit is obtained based on at least the benchmark voltage and the initial sensing voltage, and a threshold voltage of the driving transistor is obtained based on the sensing voltage;

wherein a predetermined interval is set between adjacent display frames; and the reference charging period and the data charging period are both in a same predetermined interval;

wherein the reference charging period is before the data charging period;

the driving method further comprises:

during a supplementary reference charging period, applying the reference data voltage to the gate electrode of the driving transistor to charge the sensing line through the first electrode of the driving transistor, and at the first time duration after applying the reference data voltage, obtaining a supplementary benchmark voltage from the sensing line;

wherein the reference charging period, the supplementary reference charging period and the data charging period are all in a same predetermined interval, and the supplementary reference charging period is after the data charging period; and the sensing voltage of the pixel circuit is obtained based on the benchmark voltage, the supplementary benchmark voltage and the initial sensing voltage.

15. The driving method of the display panel according to claim 14, further comprising:

establishing a compensation amount of a sub-pixel unit comprising the pixel circuit according to the threshold voltage being obtained.

16. The driving method of the display panel according to claim 15, further comprising:

during a display operation period of the display panel, compensating the sub-pixel unit with the compensation amount.

17. A display panel, comprising a pixel circuit, a sensing line and a control circuit, wherein the pixel circuit comprises a driving transistor, the driving transistor comprises a gate electrode and a first electrode, the sensing line is coupled to the first electrode of the driving transistor;

the control circuit is configured to perform a detection method of the pixel circuit or a driving method of the display panel as follows:

during a reference charging period, applying a reference data voltage to the gate electrode of the driving transistor to charge the sensing line through the first electrode of the driving transistor, and at a first time duration after applying the reference data voltage, obtaining a benchmark voltage from the sensing line; and during a data charging period, applying a detection data voltage different from the reference data voltage to the gate electrode of the driving transistor to charge the sensing line through the first electrode of the driving transistor, and at the first time duration after applying the detection data voltage, obtaining an initial sensing voltage from the sensing line;

wherein a sensing voltage of the pixel circuit is obtained based on at least the benchmark voltage and the initial sensing voltage, and a threshold voltage of the driving transistor is obtained based on the sensing voltage;

wherein a predetermined interval is set between adjacent display frames; and the reference charging period and the data charging period are both in a same predetermined interval;

wherein the reference charging period is before the data charging period;

a detection method of the pixel circuit or a driving method of the display panel further comprises:

during a supplementary reference charging period, applying the reference data voltage to the gate electrode of the driving transistor to charge the sensing line through the first electrode of the driving transistor, and at the first time duration after applying the reference data voltage, obtaining a supplementary benchmark voltage from the sensing line:

wherein the reference charging period, the supplementary reference charging period and the data charging period are all in a same predetermined interval, and the supplementary reference charging period is after the data charging period; and the sensing voltage of the pixel circuit is obtained based on the benchmark voltage, the supplementary benchmark voltage and the initial sensing voltage.

* * * * *